US008635733B2

(12) United States Patent
Bardzilowski

(10) Patent No.: US 8,635,733 B2
(45) Date of Patent: Jan. 28, 2014

(54) GOLF CLUB HEAD AND GOLF SHOE CLEANER

(75) Inventor: Joseph Bardzilowski, Princeton, NJ (US)

(73) Assignee: Wunderbrush, LLC, Princeton, NJ (US)

( * ) Notice: Subject to any disclaimer, the term of this patent is extended or adjusted under 35 U.S.C. 154(b) by 22 days.

(21) Appl. No.: 13/537,453

(22) Filed: Jun. 29, 2012

(65) Prior Publication Data

US 2014/0000050 A1 Jan. 2, 2014

(51) Int. Cl.
*A63B 57/00* (2006.01)
*A46B 13/00* (2006.01)

(52) U.S. Cl.
USPC ..... 15/160; 15/161; 15/246; 301/37.41

(58) Field of Classification Search
USPC ..... 15/160, 161, 246, 88.4, 49.1, 41.1, 42, 15/21.1; 301/37.41, 37.102, 37.106, 301/37.107; 280/164.2, DIG. 6
See application file for complete search history.

(56) References Cited

U.S. PATENT DOCUMENTS

| | | | | |
|---|---|---|---|---|
| 3,747,150 | A * | 7/1973 | Kozub | 15/105 |
| 4,940,349 | A | 7/1990 | Jansen Van Rensburg | |
| 5,224,233 | A | 7/1993 | Rich | |
| 5,235,716 | A | 8/1993 | Stella | |
| 5,555,589 | A | 9/1996 | Moultrie | |
| 5,666,684 | A | 9/1997 | Cussen | |
| 5,787,539 | A | 8/1998 | Nussbaum | |
| 6,112,364 | A | 9/2000 | Myers | |
| 6,430,770 | B1 | 8/2002 | Glass | |
| 7,137,644 | B2 | 11/2006 | Kimberley | |
| 7,543,840 | B2 | 6/2009 | Lin | |
| 7,555,802 | B2 | 7/2009 | Bohannon | |
| 7,654,920 | B2 | 2/2010 | Perry | |
| 7,752,701 | B2 | 7/2010 | Bohannon et al. | |
| 7,841,037 | B2 | 11/2010 | Cieri | |
| 7,904,986 | B2 | 3/2011 | Cieri | |
| 2009/0152857 | A1 | 6/2009 | Easley | |
| 2011/0099736 | A1 | 5/2011 | Arledge | |

FOREIGN PATENT DOCUMENTS

| | | | | |
|---|---|---|---|---|
| WO | WO 9529742 A1 * | 11/1995 | ..... | A46B 13/00 |

* cited by examiner

*Primary Examiner* — Mark Spisich
*Assistant Examiner* — Andrew A Horton
(74) *Attorney, Agent, or Firm* — Daniel Kirshner

(57) ABSTRACT

Golf club head and golf shoe cleaner brush assembly which is attached to spokes of a golf trolley wheel comprising a brush formed from wire bristles. Extending back from the brush is a brush connecting rod with male screw threads. The brush is attached to a wheel attachment member by threading its metal core into a threaded receiving hub on the wheel attachment member using a counter-clockwise screwing direction. The wheel attachment member, is attached to a wheel of the trolley by inserting screws through screw apertures located on its radially extending arms. The screws are screwed into spoke attachment clips, each including a notch which cradles a spoke. A golfer touches his golf club head to the brush and pulls the golf trolley, causing the brush to rotate, and cleaning the golf club. The golfer may touch cleats of golf shoes to the invention, thereby cleaning away dirt.

2 Claims, 4 Drawing Sheets

GOLF CLUB HEAD AND GOLF SHOE CLEANER

CROSS REFERENCE TO RELATED APPLICATION

This application is related to and claims priority and a filing date of the Provisional Application bearing Application No. 60/571,991 and a filing date of Jul. 8, 2011.

FIELD OF THE INVENTION

The present invention is a golf club head and golf shoe cleaner. More specifically, the present invention is a golf club head and shoe cleaner brush assembly for attachment to the wheel of a golf trolley.

BACKGROUND OF THE INVENTION

Golf is one of the most popular sports in the world. It is important for golfers to clean dirt, grime, soil and grass from the head of his golf clubs, particularly after a shot which creates a divot. The benefits of cleaning the head of the golf club are significant. A clean golf club head makes better contact with the golf ball thereby permitting truer shots and greater distance. Moreover, for golf shots where imparting spin onto the ball is important, such spin may be impeded by dirt on the club head. Moreover, dirt on the golf club may be transmitted to the golf bag. Furthermore, dirt on the golf club may decrease the life expectancy and/or resale value of the club. As such, golfers typically clean the head of the golf club after each shot.

Likewise, there are benefits to the golfer from having golf shoes whose soles are free of soil and grass. Golfers typically wear golf shoes that have cleats or spikes attached to their soles. Particularly in muddy soil, but even at other times, dirt, soil and grass have a tendency to build up in the cleats. This is a disadvantage to golfers as their footing and balance suffers as a result. In order to get a true hit on the golf ball, the golfer's stance, balance and footing is essential. As such, it is an advantage to the golfer to have a convenient means to keep the cleats of his golf shoes free of soil and grass.

A golfer has various options to transport a bag of golf clubs around a golf course. One may carry his golf clubs from shot to shot. This becomes tiresome as the player must walk hundreds of yards toting a bag of clubs that may have significant weight. This in turn may lead to poorer golf scores due to fatigue. A second alternative is for a golfer to rent a motorized golf cart. Although this alleviates the problem of fatigue from transporting the golf bag, it does so at significant expense. As such, many players now employ golf bag trolleys which are wheeled carts that are pushed or pulled around the golf course and transport the golf bag. These may be rented at the golf course, but are typically inexpensive enough that even casual golfers may purchase one.

The prior art is replete with golf trolleys. These golf trolleys typically have three wheels (sometimes two) and a handle which is utilized to pull or push the trolley around the golf course. In addition, there is a platform or retaining member for placement of the golf bags containing the golf clubs. Examples of such prior art golf trolleys are disclosed in U.S. Pat. No. 7,137,644 B2 entitled Collapsible Golf Cart and U.S. Pat. No. 7,543,840 entitled Collapsible Golf Cart.

Similarly, there are many, many devices for cleaning the heads of golf clubs disclosed in the prior art. These may be hand-held devices (e.g. U.S. Pat. No. 7,752,701 entitled Cleaning Device for Golf Equipment), multiple application golf tools (e.g. U.S. Pat. No. 7,654,920 entitled Multi-Purpose Golf Accessory Assembly), devices that stick into the turf (e.g. U.S. Pat. No. 7,904,986 entitled Golf Club Cleaning Device), devices that wash the golf clubs using cleaning fluid (e.g. U.S. Pat. No. 6,430,770 entitled Portable Golf Club Head Cleaning Device) and motorized golf club cleaners (e.g. U.S. Pat. No. 5,787,539 entitled Golf Club Cleaner.) Most commonly, golfers use a hand towel to wipe dirt and grime from the head of the club.

Devices that have some similarity to the presently disclosed invention are shown in the United States Patent Application Publication No. US 2011/0099736 A1 and United States Patent Application Publication No. US 2009/0152857, both of which have serious disadvantages as compared to the invention disclosed herein.

None of the prior art achieved the objectives of the present invention. As such, it is an objective of the present invention to provide a golf club head and golf shoe cleaning brush assembly that attaches to a golf trolley that has the combines the functionality of transporting a bag of golf clubs around a golf course with the functionality of cleaning the head of a golf club and the soles of the golf shoes. It is an objective of the present invention to utilize the rotational energy of a wheel of the golf trolley to provide power for cleaning the head of a golf club. It is further an objective of the present invention to provide a device that a golfer can use to clean the head of a golf club at the same time as walking with the bag containing the golf clubs.

Other objectives, advantages and novel features, and further scope of applicability of the present invention will be set forth in the detailed description to follow, taken in conjunction with the accompanying drawings, will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a golf club head and golf shoe cleaner brush assembly which is attached to the spokes of a wheel of a golf trolley. The golf club head cleaner of the present invention comprises a brush formed from wire or other stiff bristles wound around a metal core. Extending out from the back of the metal core is a threaded brush connecting rod with male screw threads. Extending from the front of the metal core is a wire loop which can be employed to tighten the brush to the wheel using a golf tee. The brush is attached to a wheel attachment member by threading the metal core into a threaded receiving hub on the wheel attachment member. A counter-clockwise screwing direction is utilized to counteract the potential for the brush to loosen up due to the rotation of the wheel. The wheel attachment member, which has radially extending arms, is attached to a wheel of the trolley by inserting screws through screw apertures located on its arms. The screws are then screwed into spoke attachment clips, each of which includes a notch which cradles a spoke of the wheel. Once the brush is attached to the wheel the device is ready to be used. A golfer touches his soiled golf club head to the brush of the present device and pulls or pushes the golf trolley, thereby causing the brush to rotate, and thus cleaning the golf club. Alternatively, the golfer may touch the cleats of his golf shoes to the present invention, thereby cleaning away dirt and debris.

BRIEF DESCRIPTION OF THE FIGURES

For a better understanding of the present invention, reference is made to the following description of an exemplary embodiment thereof, considered in conjunction with the accompanying drawings, in which.

DETAILED DESCRIPTION OF THE INVENTION

Figure 1:
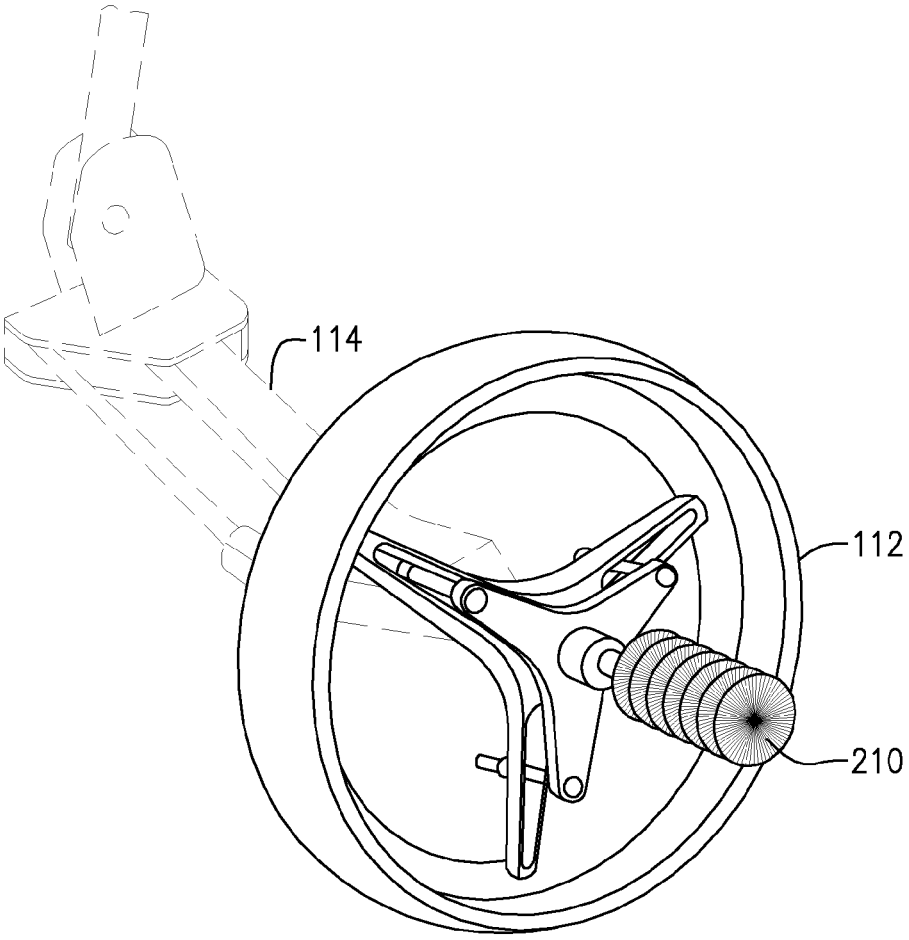
FIG. 1 is a front perspective view of the present invention golf club head and golf shoe cleaner brush assembly.
Figure 2:
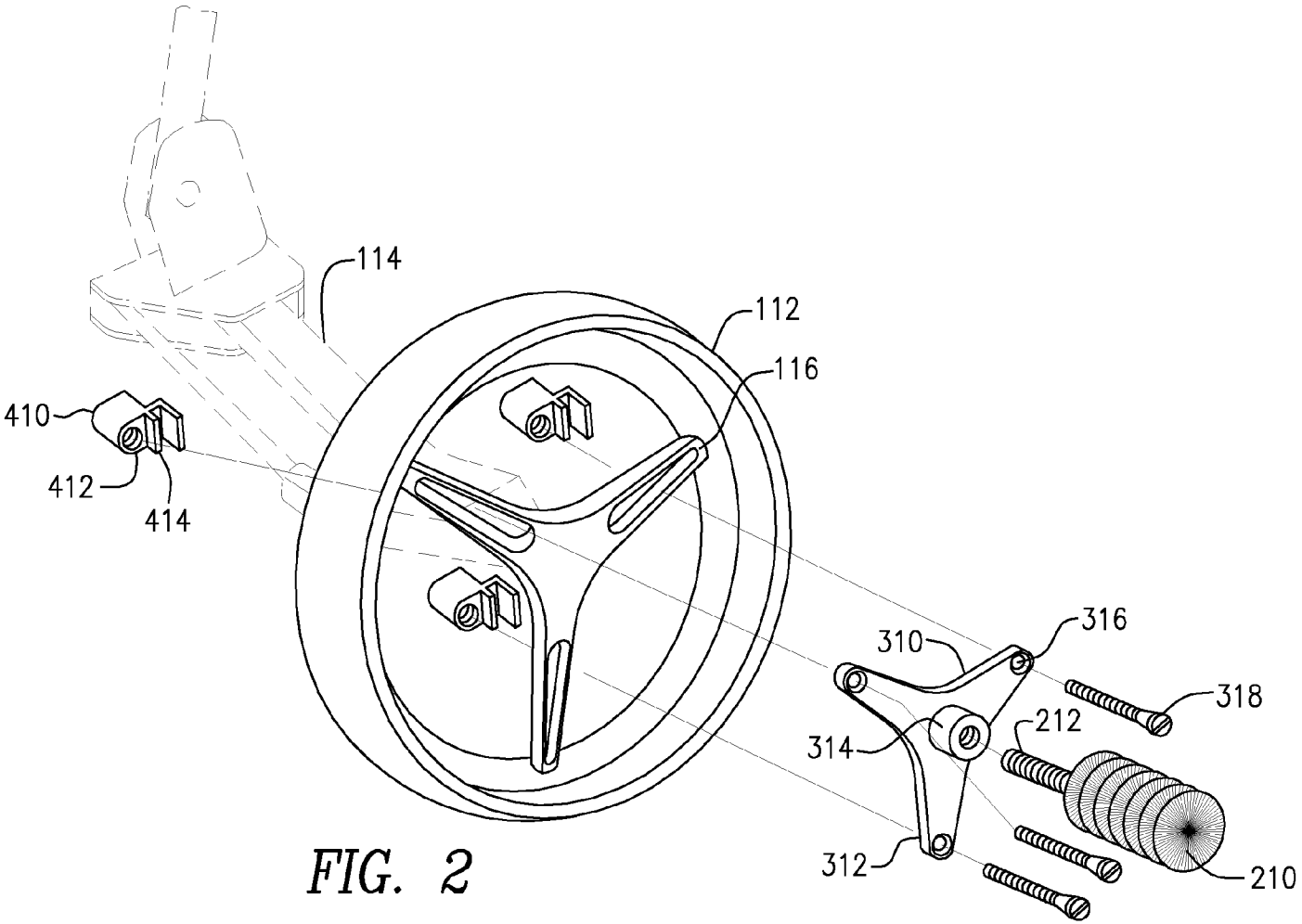
FIG. 2 is a front perspective view of the present invention brush assembly shown in exploded condition.
Figure 3:
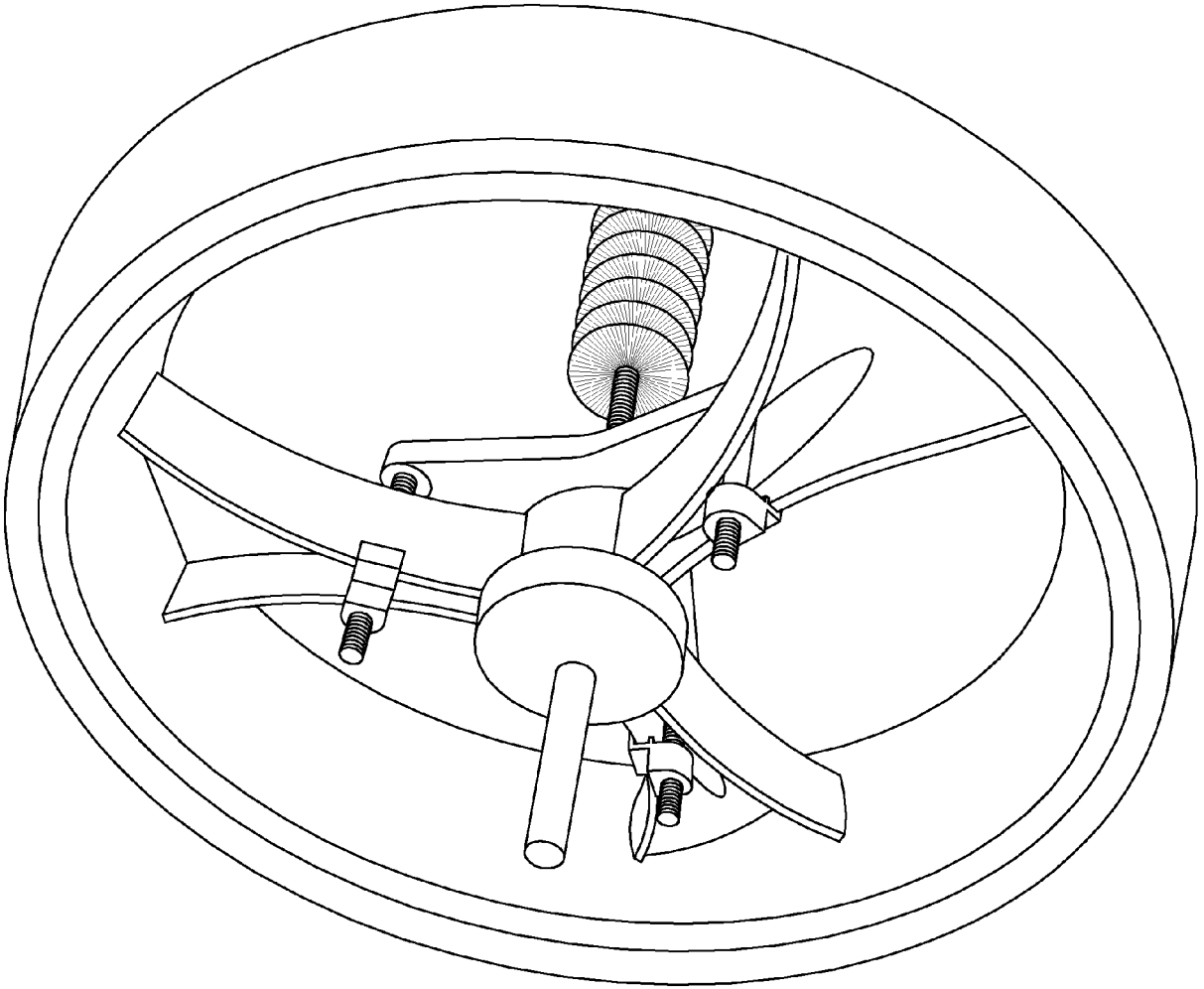
FIG. 3 is a rear perspective view of the present invention brush assembly.
Figure 4:
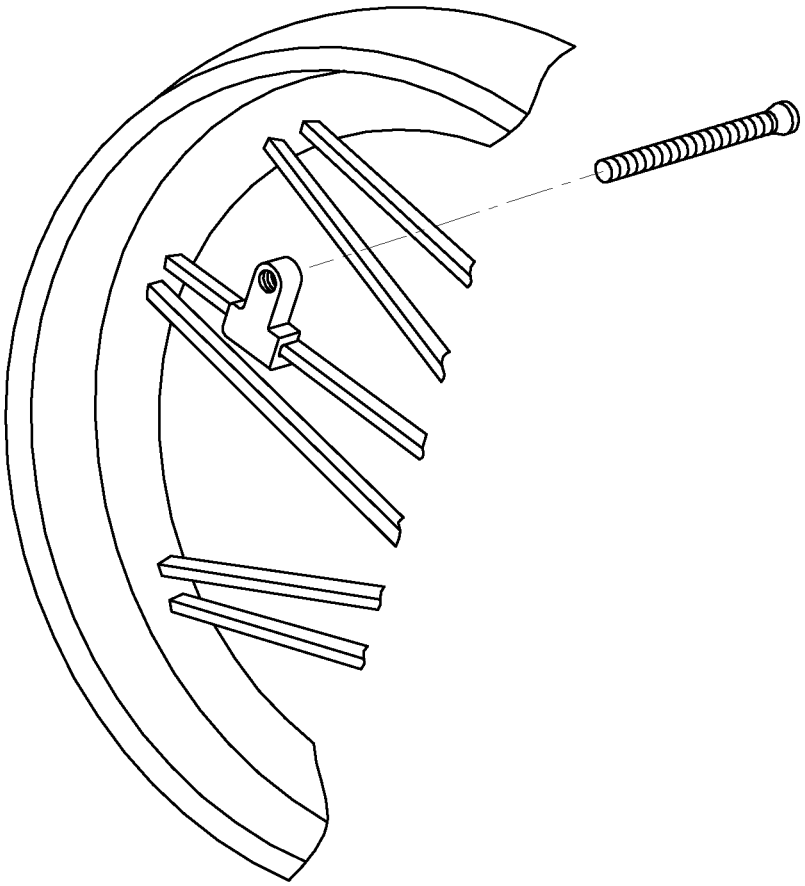
FIG. 4 is a partial view of a golf trolley wheel showing a spoke attachment clip of the present invention brush assembly as it is attached to the spoke of the wheel of the trolley and showing the screw in exploded condition.

The present invention is a golf club head and golf shoe cleaning brush assembly that combines the functionality of transporting a bag of golf clubs around a golf course with the functionality of cleaning dirt, grime and grass from the head of a golf club. This combined functionality is achieved by attaching a wire or otherwise stiffly bristled brush to one of the wheels of the trolley. In this manner, when the trolley is being pulled or pushed around the golf course, the rotation of the wheels causes the brush to rotate. This rotational energy is thereby employed to clean the head of a golf club.

There are many golf trolleys in the prior art, which typical golf trolleys include three or four wheels (sometimes the trolleys are two-wheeled.) Attached to the wheels is a carrying bag for carrying the golf clubs, golf balls, and other golf accessories. In turn, these elements are attached to a pulling or pushing handle for maneuvering the trolley around the golf course.

Looking now at the figures, which figures show one wheel of the trolley 112 and a connecting portion to connect the wheel to golf club carrying portion of the golf trolley 114. The wheel of a golf trolley has spokes 116. As shown the figures, the wheel of the golf trolley has three spokes, but this number may change from one model trolley to the next.

Now, attention is turned to the wire brush 210 of the present invention. The wire brush is attached to one of the wheels of the trolley. It is not critical which wheel the brush is attached to. As such, the brush could be attached to either of the rear wheels or even the front wheel. Moreover, the brush is disclosed as having wire bristles, but it is within the scope of this disclosure to provide a brush with plastic bristles, straw bristles or other such stiff bristles. As shown, the wire brush is generally cylindrical having its bristles wound around a metal core. Extending out from the back of the cylindrical wire brush is a brush connecting rod 212. The brush connecting rod is threaded with male screw threads. The brush bristles are wound in a spiral pattern around an inner metal core. In the preferred embodiment, the inner metal core extends past the front edge of the brush and takes the form of a loop. The loop is advantageous in that a user can use a standard golf tee inserted into the loop, to further tighten the brush assembly to the wheel of the trolley.

The brush connecting rod is attached to the wheel attachment member 310. The wheel attachment member is employed to attach the brush to the spokes of a wheel of the trolley. The wheel attachment member 310 as shown in this embodiment has three arms 312 that extend outward from its center in an equilateral configuration. At the center of the wheel attachment member is a threaded receiving hub 314, threaded with female threads, for connecting the wheel attachment member to the brush connecting rod. The threaded receiving hub extends upward from the front face of the wheel attachment member as a circular protrusion. The brush connecting rod is threaded so that when it is screwed into the threaded receiving hub 314, the brush connecting rod is screwed in by being rotated in a counter-clockwise direction. This counter-clockwise direction of attachment of the screw is advantageous to counteract the potential tendency of the screw to loosen up if it were connected by being screwed in a clockwise direction, this loosening tendency being due to the rotation of the wheel of the trolley. At the end of each of the three arms of the wheel attachment members are located screw apertures 316 for insertion of screws 318 therethrough.

A plurality (as shown three) of spoke attachment clips 410 are provided. Each of the spoke attachment clips include a female-threaded screw hole 412 and a spoke receiving notch 414 for receiving the wheel's spoke. The notch of each of the spoke attachment clips consists of two parallel walls defining the notch therebetween. The wall further away from the screw hole is longer than the wall closer.

The wheel attachment member 310 is positioned against the spokes of the golf trolley. It will be understood that the wheel attachment member is positioned on the outside of the wheel. i.e. not the inside of the wheel attached to the trolley. Screws 318 are provided, which screws are inserted though the screw apertures 316 on the wheel attachment member. Now, the spoke attachment clips 410 are situated on the inside of the wheel, and the screws are threaded into the clips. Further, the notches 414 of the clips cradle a spoke of the wheel. In other words, a spoke is positioned between the two side wall of the notch so that the spoke is firmly cradled into the notch. Now, when the screws are tightened down, the wheel attachment member is firmly attached to the wheel.

Finally, the brush is attached to the wheel attachment member by screwing the brush connecting rod 212 into the threaded receiving hub 314, the brush connecting rod is screwed in by being rotated in a counter-clockwise direction. The brush may be tightened firmly into place by inserting a golf tee into the loop at end of the brush connecting rod and rotating.

The wheel attachment member may be left permanently attached to the wheel of the trolley if so desired by the user. The brush may likewise be permanently attached to the wheel attachment member, or can be removed as desired by user for ease of storage.

To utilize the present invention, the golfer pushes or pulls the trolley as it is carrying the golf bag thereby causing its wheel to rotate about its axle. This, in turn, causes the attached brush to rotate along with the wheel. Now, as the brush is rotating, the golfer touches the head of the dirty golf club to the rotating brush, thereby cleaning the club. As such, the rotational energy of the wheels is imparted to the brush thereby improving its cleaning capabilities. Furthermore, the golfer saves time and energy, as he is permitted to clean the head of the golf club at the same time as he walks and transports his golf bag. Alternatively, the golfer may touch the soiled soles of his golf shoes to the rotating brush, thereby cleaning away soil and debris.

The foregoing is considered as illustrative only of the principles and preferred embodiment of the invention. Furthermore, since numerous changes and modifications will readily occur to one skilled in the art, it is not desired to limit the invention to the exact construction, operation and embodiment shown and described, and accordingly all suitable modifications and equivalents may be resorted to, falling within the scope of the invention.

What is claimed:

1. A brush assembly for attachment to a spoked wheel of a golf trolley for cleaning a head of a golf club or the shoes of a golfer, comprising:

a wheel attachment member having a center, said wheel attachment member having arms that extend radially outward from its center, each arm having a screw aperture, said wheel attachment member further including a threaded receiving hub at its center;

a brush, said brush connected to a brush connecting rod for attachment to said threaded receiving hub;

a plurality of spoke attachment clips, each of said spoke attachment clips including a threaded screw hole, and each of said spoke attachment clips further including a spoke receiving notch, a plurality of screws, said screws inserted through said screw apertures on said wheel attachment member, said screws screwed into said threaded screw holes on said spoke-attachment clips, each of said spoke receiving notches cradling a spoke of said wheel, thereby attaching said brush assembly to said wheel, whereby said brush connecting rod is attached to said wheel attachment member by screwing in a counterclockwise direction.

2. A brush assembly for attachment to a spoked wheel of a golf trolley for cleaning a head of a golf club or the shoes of a golfer, comprising:

a wheel attachment member having a center and having screw apertures, said wheel attachment member further including a threaded receiving hub at its center;

a brush, said brush connected to a brush connecting rod for attachment to said threaded receiving hub;

a plurality of spoke attachment clips, each of said spoke attachment clips including a threaded screw hole, and each of said spoke attachment clips further including a spoke receiving notch, a plurality of screws, said screws inserted through said screw apertures on said wheel attachment member, said screws screwed into said threaded screw holes on said spoke attachment clips, each of said spoke receiving notches cradling a spoke of said wheel, thereby attaching said brush assembly to said wheel.

* * * * *